United States Patent [19]

Gilhaus

[11] Patent Number: 4,893,379

[45] Date of Patent: Jan. 16, 1990

[54] TOW STEAMING APPARATUS WITH ADJUSTABLE STEAM CHANNEL CROSS SECTION

[75] Inventor: Konrad Gilhaus, Bielefeld, Fed. Rep. of Germany

[73] Assignee: Spinnereimaschinenfabrik Seydel & Co. GmbH, Bielefeld, Fed. Rep. of Germany

[21] Appl. No.: 184,972

[22] Filed: Apr. 22, 1988

[30] Foreign Application Priority Data

May 19, 1987 [DE] Fed. Rep. of Germany ..... 3716690

[51] Int. Cl.[4] ..... D01B 9/00

[52] U.S. Cl. ..... 19/66 T; 68/5 D

[58] Field of Search ..... 38/14; 19/66 R, 66 T; 68/5 D, 5 C, 5 E; 100/151

[56] References Cited

U.S. PATENT DOCUMENTS

| | | | |
|---|---|---|---|
| 3,197,896 | 8/1965 | Fleissner | 38/14 |
| 3,370,325 | 2/1968 | Wellman | 19/66 R |
| 3,413,731 | 12/1968 | Fleissner | 68/5 D |
| 3,638,562 | 2/1972 | Karaghiosoff | 100/151 |
| 4,074,546 | 2/1978 | Roberson | 19/66 R X |
| 4,599,814 | 7/1986 | Gerger | 38/14 |

FOREIGN PATENT DOCUMENTS 20206 6/1982 Fed. Rep. of Germany .

*Primary Examiner*—Andrew M. Falik

*Attorney, Agent, or Firm*—Becker & Becker, Inc.

[57] ABSTRACT

An apparatus for continuously steaming filament tows or fiber slivers following a stretch-break converting machine. A steam channel receives saturated steam for releasing and eliminating shrinkage from filament tows or fiber slivers in the channel. To improve the elimination of shrinkage, the counterpressure against the filament tows or fiber slivers in the steam channel is adjustable. To effect this adjustment, a pivotable flap can be disposed at the outflow end of the steam channel to vary the cross-sectional area of the latter.

17 Claims, 2 Drawing Sheets

TOW STEAMING APPARATUS WITH ADJUSTABLE STEAM CHANNEL CROSS SECTION

BACKGROUND OF THE INVENTION

The present invention relates to an apparatus for continuously steaming filament tows or fiber slivers following a stretch-break converting machine.

In a machine for stretch-break converting filament tows or fiber slivers the endless tows or finite-length fibers of the slivers are broken by being stretched. The stressing of the fibers to the point of breaking elongation results in a potential shrinkage of the fibers, so that the fiber slivers that are delivered are characterized by a distribution of fiber length that is less than what was received. During the further processing of textiles, such a fiber shrinkage is desired in only certain situations. Thus, in those situations where the fiber shrinkage is not desired, in recent times, following the stretch-break conversion process, the fiber shrinkage is predominantly continuously released and hence eliminated in a steaming apparatus, which follows the stretch-break converting machine, via hydrothermic treatment, preferably by treating the fibers with saturated steam.

German Gebrauchsmuster No. 82 02 206 dated June 24, 1982 discloses a continuously operating steaming apparatus for filament tows or fiber slivers following a stretch-break converting machine. This steaming apparatus is provided with an S-shaped steam channel ahead of which is disposed an inlet zone in the form of an adapter. These S-shaped steam channels can have a round, tubular cross-sectional shape.

A steaming apparatus is also known where the steam channels have a quadratic cross-sectional shape, with the central portion of the apparatus having a guide mechanism that deflects the fiber material by 30°. This steaming apparatus is characterized by an introduction of the steam via holes that are distributed all the way around in the inlet region of the steam channel, as well as by a channel connector that has a considerably smaller cross-sectional shape and extends into the steam channel.

A critical feature of the heretofore known steaming apparatus is the utilization of the force of gravity and the frictional force (with the S-shaped steam channel via the deflection) in order to offer to the inflowing steam an adequate counterpressure. With an S-shaped steam channel, this goal is achieved to only a limited extent. With the steaming apparatus where the central portion is bent in order to deflect the fiber material, the shrinkage is not adequately eliminated. Thus, it is impossible to totally eliminate shrinkage with the heretofore known steaming apparatus. Furthermore, all of the heretofore known steaming apparatus are limited to using saturated steam at nearly atmospheric pressure, i.e. at temperatures of 100° C.

SUMMARY OF THE INVENTION

It is therefore an object of the present invention to improve the elimination of shrinkage of the heretofore known steaming apparatus after the filament tow or fiber slivers have been stretch-break converted.

The steaming apparatus of the present invention includes a housing having an inlet for receiving saturated steam which passes through a steam channel that is disposed in the housing. The steam channel receives steam employed to release and eliminate shrinkage from the filament tows or fiber slivers in the steam channel. Means to vary cross-sectional area are operatively connected to the steam channel for adjusting counterpressure therein against the filament tows or fiber slivers in the steam channel. A pivotable flap disposed at the outflow end of the steam channel makes it possible to vary the cross-sectional area of the latter. Such a pivotable flap has the advantage that the counterpressure can be adjusted in a technically straightforward manner. By pivoting the flap in a direction toward the filament tows or fiber slivers, the cross-sectional area at the outflow end of the steam channel can be reduced and consequently the counterpressure upon the filament tows or fiber slivers can be increased, whereas by pivoting the flap in the other direction, the cross-sectional area at the outflow end of the steam channel can be increased and consequently the counterpressure upon the filament tows or fiber slivers can be reduced. The flap is preferably provided with steam introduction openings that on the back side of the flap communicate with a steam feed mechanism. Parameters including "pressure, temperature, retention time" important for steaming operation, can be varied so that elimination of shrinkage can be optimized as a function of the respective filament tows or fiber slivers making it possible to achieve a nearly total elimination of shrinkage thereof.

BRIEF DESCRIPTION OF THE DRAWING

This object, and other objects and advantages of the present invention, will appear more clearly from the following specification in conjunction with the accompanying schematic drawing, in which.

Figure 1:
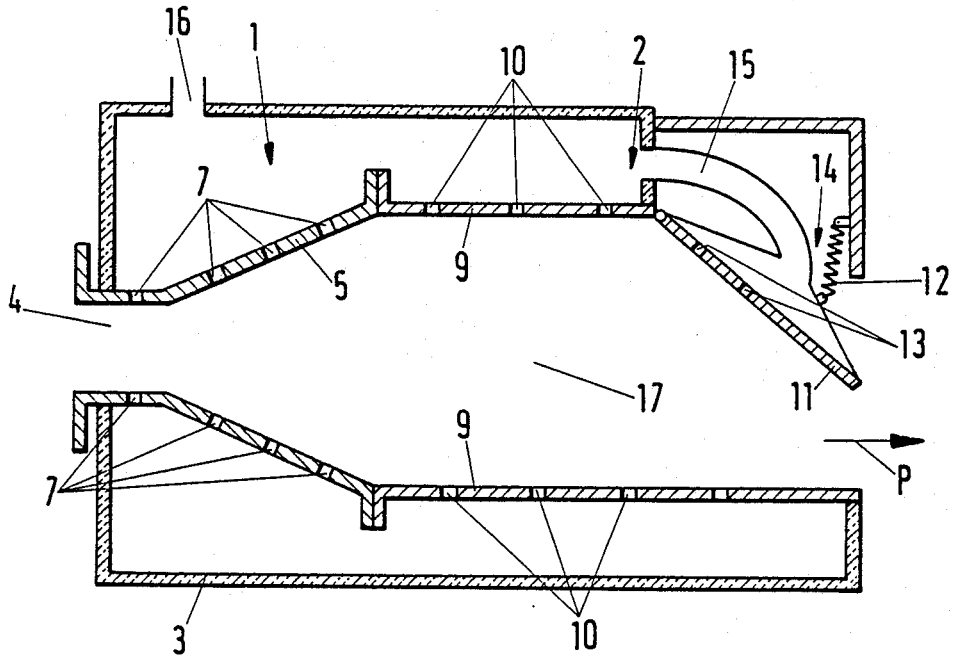
FIG. 1 is a vertical cross-sectional view through one exemplary embodiment of the inventive steaming apparatus.

Further specific features of the present invention will be described in detail subsequently.

DESCRIPTION OF THE PREFERRED EMBODIMENTS

Referring now to the drawing in detail, the illustrated apparatus for continuously steaming filament tows or fiber slivers principally comprises an adapter 1, downstream of which is disposed a steam channel 2. The adapter 1 and the steam channel 2 are surrounded by a common, heat-insulating housing 3. Although the filament tows or fiber slivers are not illustrated, their direction of feed within the steaming apparatus is indicated by the arrow P at the outflow end of the apparatus.

The adapter 1 is connected, for example, to a non-illustrated stretch-break converting machine, and is provided with an inlet opening 4. Up to a certain distance into the housing 3, the adapter 1 is tubular with a constant cross-sectional shape. Relative to a vertical cross section (FIG. 1), a funnel-shaped widened portion 5 adjoins the tubular portion, whereas relative to a horizontal cross section (FIG. 2), the cross-sectional shape remains constant over a majority of the length of the adapter, although at the end of the adapter a short, similarly funnel-shaped widened portion 6 is provided that at the very end has a cross-sectional shape that corresponds to the horizontal cross-sectional shape of the following steam channel 2. The adapter 1 is provided with steam introduction openings 7 that are distributed over the periphery of the adapter.

Figure 2:
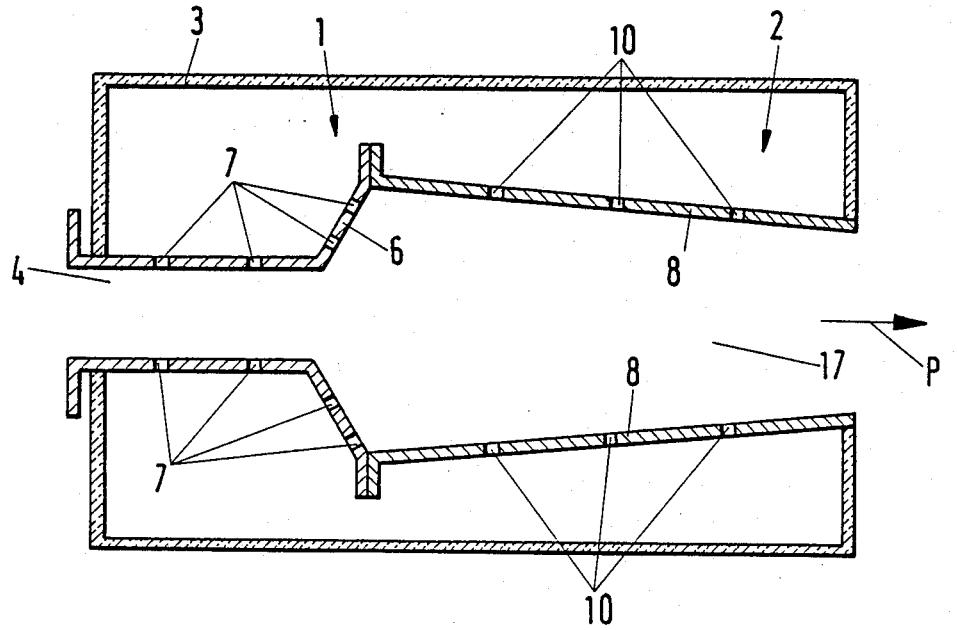
FIG. 2 is another cross-sectional view also taken through the steaming apparatus of FIG. 1.

As can be seen from the horizontal cross-sectional view of FIG. 2, the steam channel 2 is provided with walls 8 that are angled inwardly in such a way that they are tapered in a funnel-like manner toward the outflow end of the steam channel 2. In contrast, in the vertical cross-sectional view of FIG. 1 it can be seen that the upper and lower walls 9 extend horizontally and are not inclined. Not only the walls 8 but also the walls 9 of the steam channel 2 are provided with steam introduction openings 10 that are distributed over the peripheries of the walls.

Figure 3:
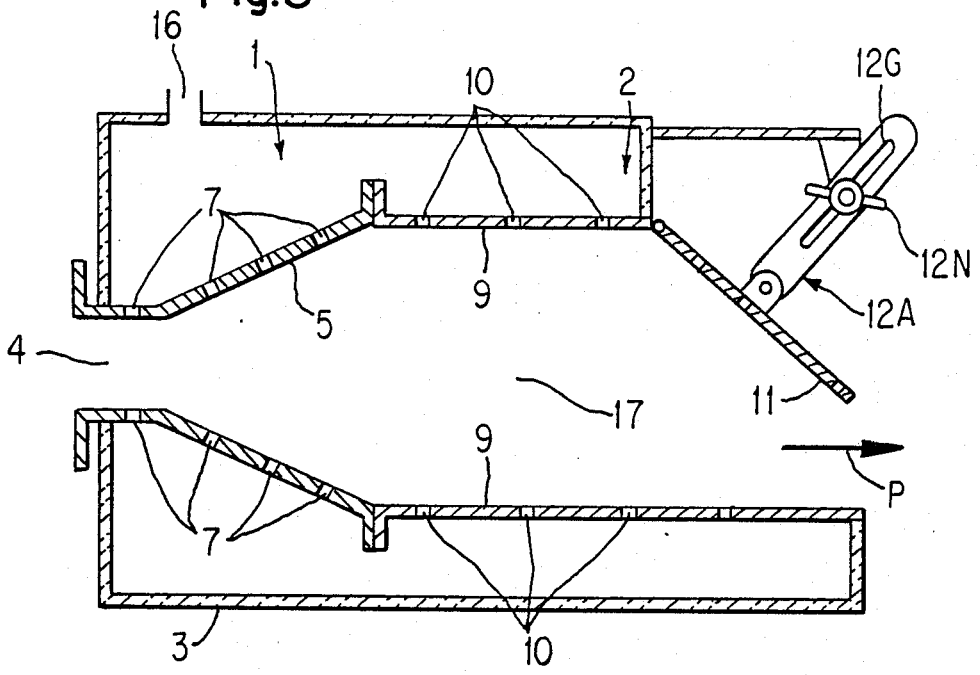
FIG. 3 is a vertical cross-sectional view similar to that of FIG. 1 modified to show fixedly setting means.
Figure 4:
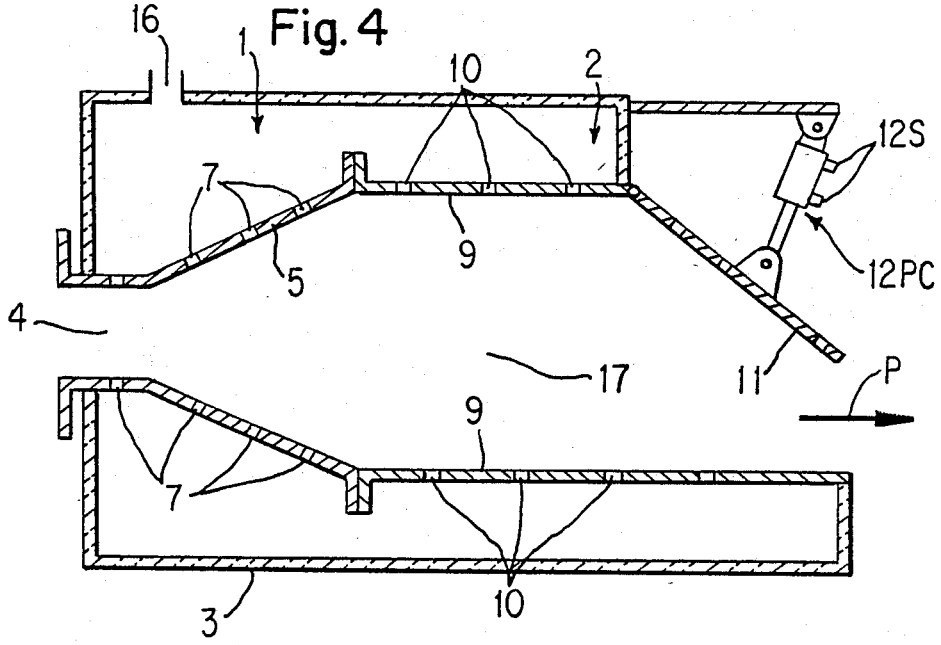
FIG. 4 is another vertical cross-sectional view similar to that of FIG. 1 modified to show the piston-cylinder unit.

As can be seen in FIG. 1, a flap 11 is connected to the upper wall 9 of the steam channel 2. The flap 11 is under the influence of a pressure spring 12 that presses the flap downwardly in an attempt to reduce the cross-sectional area at the outflow end of the steam channel 2. It would, of course, also be possible to use other means, such as a fixedly setting means 12A with a guide slot/groove 12G and wing nut 12N of FIG. 3 or piston/cylinder unit 12PC with supply lines 12S of FIG. 4, in place of the spring 12.

The flap 11 is also provided with steam introduction openings 13 that on the back side of the flap 11 are provided with a common steam feed mechanism 14. The latter includes a steam feed channel 15 that is connected to the housing 3, which surrounds both the adapter 1 and the steam channel 2.

In the illustrated embodiment, the adapter 1 and the steam channel 2 are illustrated as separate components. However, it would also be conceivable to provide an integrated configuration of these two parts.

The steaming apparatus of the present invention operates as follows:

The filament tow or fiber sliver that is to be steamed is fed to the steaming apparatus through the inlet opening 4 in the adapter 1. The purpose of the steaming operation is to eliminate the fiber shrinkage that occurs during breaking. For this purpose, the filament tow or fiber sliver is conveyed through the steaming apparatus (from left to right in the drawing) and is acted upon by saturated steam that is supplied to the housing 3 via an inlet 16 and, via the steam introduction openings 7 in the adapter 1, the steam introduction openings 10 in the walls 8, 9 of the steam channel 2, and via the steam introduction openings 13 in the flap 11, this steam is conveyed into the interior of the apparatus for treating the filament tow or fiber sliver. The supply of saturated steam to the steam introduction openings 13 in the flap 11 is effected via the steam feed channel 15, which branches off from the housing 3.

As a result of the novel configuration of the adapter 1, a preferred folding of the filament tow or fiber sliver is achieved in the vertical direction. This assures that the steamed filament tow or fiber sliver can be continuously withdrawn layer for layer at the outlet of the steam channel 2. In this connection, the spring 12 presses the flap 11 downwardly and tries to reduce the cross-sectional area at the outflow end of the steam channel 2. In the manner of a cake, the pressure exerted by the filament tow or fiber sliver opposes the pressure spring 12 and tries to press the flap 11 upwardly. In this manner, a counterpressure is exerted upon the filament tow or fiber sliver, with the flap 11 being held in a position that varies as a function of pressure. In this manner, the filament tow or fiber sliver seals off a steam chamber 17 at the inlet and outlet ends, with this steam chamber 17 being formed by the interior of both the adapter 1 and the steam channel 2. As a result, the steam pressure, and consequently the steam temperature, as well as the retention time of the filament tow or fiber slivers, can be set in the steam chamber 17. In particular, this is done as a function of t he material of the filament tow or fiber slivers. As a result, the fiber shrinkage can be eliminated in an optimum manner.

The flap 11 is adapted to provide a reduction of the cross-sectional area of the steam channel 2 in a range of from 5 to 60%. The cross section of the steam channel 2 is tapered up to 10%.

The adapter 1 is disposed upstream of the steam channel 2 and has an end that is connected to the inflow end of the steam channel 2; in a first transverse direction, the adapter is widened in a funnel-like manner to be equal to the cross section of the steam channel in this first transverse direction; in a second transverse direction, perpendicular to the first transverse direction, the adapter 1 first has an essentially constant cross section, and subsequently, in the region of the end of the adapter that is connected to the inflow end of the steam channel, is widened in a funnel-like manner to be equal to the cross section of the steam channel in this second transverse direction. The widening of the adapter 1 in the first transverse direction is effected over a distance that is at least twice as long as the distance over which the widening of the adapter 1 in the second transverse direction if effected. The interior of the adapter 1 is also provided with a friction-reducing surface coating. The friction-reducing surface coating comprises polytetrafluoroethylene (PTFE). As a result of such a friction-reducing surface coating, the counterpressure can be optimally adjusted in a respective application of special filament tows or fiber slivers without the counterpressure being too greatly influenced by coefficients of friction that are too great between the fiber cake and the interior of the steam channel.

A significant advantage of the adjustability of the counterpressure upon the filament tows or fiber slivers is that the steam pressure, and hence the steam temperature, can be higher than was previously the case, as a result of which residual shrinkage in subsequent processing passes, where temperatures greater than 100° C. are used, is avoided. Furthermore the steaming process is independent of the character of the material of the steam channel in the interior, since different coefficients of friction between the filament tows and fiber slivers and the inner wall of the steam channel can be compensated for by differently adjusted counterpressures, so that congestions or clogging can be avoided by reducing the counterpressure upon the filament tows or fiber slivers. This assures a uniform delivery of the steamed fiber cake.

The adjustability of the counterpressure upon the filament tows or fiber slivers has the advantage that if the filament tows or fiber slivers seal off the inlet and outlet ends of the steam channel, the conditions of the steaming process with regard to pressure, temperature and retention time can be set in a suitable manner for the fiber cake that is to be transported in the steam channel relative to the fiber materials that are to be treated at any given time, so that in particular the variables "steam pressure" and "steam temperature" can be set to the desired values. Even without sealing off the inlet and outlet ends of the steam channel, it is still possible to adjust the retention time of the fiber material within the steam channel by adjusting the counterpressure, with this retention time being between 20 and 240 seconds, preferably between 20 and 120 seconds. Furthermore, the fiber material can be transported horizontally in the steaming apparatus, so that the height of the machine can be reduced thus facilitating handling and control of the machine. The linear configurations of the steaming apparatus permits association with a stretch-break converting machine in any desired position without having to take into consideration the force of gravity. As a result, the construction of the stretch-break converting machine can be more capable to operation, in other words, can have a low design. Especially with stretch-break converting machines having a dual-level guidance of fiber tow, the operationally compatible construction of the steaming apparatus requires a delivery of the slivers at a height that cannot be realized with the heretofore known S-shaped steam channels.

Pursuant to a first variant, the flap can be fixedly set in a preselected pivoted position. Consequently, with a fixed setting and a specific filament tow or fiber sliver, specific reproducible steaming results can be obtained. For a different filament tow or fiber silver, a resetting might have to be undertaken in order to provide optimum conditions for a complete elimination of shrinkage.

Pursuant to a second variant, the flap can be held in a position that can vary as a function of pressure via a spring or a pneumatically or hydraulically operable piston-cylinder unit or the like. In this way, the position of the flap is determined by the pressure that the filament tows or fiber slivers exert upon the flap. In other words, if the pressure of the material is high, the cross-sectional area at the outflow end of the steam channel will increase by an appropriate pivoting movement of the flap, whereas if the pressure of the material decreases, the flap is pivoted in such a way that the cross-sectional area in the steam channel decreases, so that in this manner the pressure of the material again increases due to the decreased cross-sectional area. Thus, a compensation always takes place between the pressure of the fiber cake upon the flap and the opposing force of the flap upon the fiber cake, so that an adjustment of the flap in the steam channel is realized as a function of the process. The flap is preferably provided with steam introduction openings that on the back side of the flap communicate with a steam feed mechanism. In this way, the flap participates in the process of steaming the fiber cake.

The flap is adapted to provide a reduction in a range of between 5 and 60% in the cross-sectional area of the steam channel and in this range, an optimum adaptation of the cross-sectional area of the steam channel is possible, so that a complete elimination of shrinkage can also be assured for all different kinds of fiber cakes. When the cross-sectional area of the steam channel in at least one transverse direction is tapered in a funnel-like manner up to 10%, this funnel-like tapering has a positive effect upon the elimination of shrinkage, especially in cooperation with the flap 11.

The adapter 1 is disposed upstream of the steam channel, with the adapter 1, in a first transverse direction being widened in a funnel-like manner to the cross-sectional shape of the steam channel in this transverse direction, and with the adapter, in the second transverse direction, perpendicular to the first transverse direction, initially having an essentially constant cross-sectional shape; subsequently, in this second transverse direction, and in the region of the end of the adapter 1, the cross-sectional shape of the latter is widened in a funnel-like manner to the cross-sectional shape of the steam channel in this second transverse direction. In this connection, the "first transverse direction" can be disposed in the vertical direction, and the "second transverse direction" can be disposed in the horizontal direction. This configuration of the adapter that is disposed upstream of the steam channel effects a preferred folding of the filament tow or fiber slivers in the "first (vertical) transverse direction". The sliver withdrawn from the steam channel is therefore preferably folded in one (vertical) transverse direction. Alternatively, a preferably horizontal folding of the sliver is also possible. The novel configuration of the adapter 1 permits a continuous withdrawal of the steamed filament tow or fiber sliver from the steam channel without the danger of unintentionally withdrawing sliver loops, which would lead to tearing of a sliver. The novel configuration of the inventive adapter 1 reliably avoids accumulations of sliver material in so-called "dead zones" about the adapter tube that extends into the steam channel, with such accumulations occurring in constructions where the adapters project into the steam channel.

The expansion of the cross-sectional area in the first transverse direction is preferably effected over an area that is at least twice as long as the cross-sectional area expansion in the second transverse direction. In this way, an optimum folding of the fiber sliver in the one transverse direction is assured, so that at the outlet of the steam channel, the steamed fiber sliver can be continuously withdrawn layer for layer.

According to one preferred specific embodiment, the flap 11 of the steam channel is pivotable in the plane of the funnel-like expansion of the first transverse direction of the adapter. This provides for an optimum cooperation between the special configuration of the adapter 1 and the flap 11 of the steam channel 2.

According to a further feature of the present invention, the adapter 1 and the steam channel 2 each can be provided with steam introduction openings 13 that are distributed over the periphery of these components, and that the adapter and the steam channel 2 can be surrounded by a common, heat-insulating housing via which the saturated steam is supplied to the stem introduction openings 13. By means of the additional steam introduction openings 13 in the adapter 1, the favorable effect of the steam is increased. In this way, even with raw fiber materials having a high coefficient of friction relative to steel, etc., a functionally reliable operation is assured, even at high steam pressures. As a consequence of the common, heat-insulating housing, which surrounds both the adapter 1 and the steam channel 2, steam is prevented from condensing before the steaming process can be effected.

According to another advantageous embodiment of the present invention, it is proposed that a steam feed channel 15 proceeds from the housing 3 to the back side of the flap 11. This provides a simple possibility for being able to supply the saturated steam to the steam introduction openings of the flap without requiring a special complicated and expensive construction.

The present invention is, of course, in no way restricted to the specific disclosure of the specification and drawing, but also encompasses any modifications within the scope of the appended claims.

What I claim is:

1. An apparatus for continuously steaming filament tows or fiber slivers following a stretch-break converting machine, with said apparatus comprising:

a steam channel for receiving saturated steam for steaming filament tows or fiber slivers in said steam channel to release and eliminate shrinkage from said tows or slivers that encounter pressure of movement thereof through the steam channel; and means for adjusting counterpressure against said filament tows or fiber slivers encountering pressure of movement in said steam channel, said steam channel having an inflow end where filament tows or fiber slivers enter said steam channel, and an outflow end where said tows or slivers exit said steam channel, with said means for adjusting counterpressure being a flap that is pivotably connected near said outflow end of said steam channel, whereby said flap is adapted to vary the cross-sectional area of said steam channel.

2. An apparatus according to claim 1, in which said flap is adapted to be fixedly set in a predetermined pivot position.

3. An apparatus according to claim 1, which includes means for holding said flap in a position that varies as a function of pressure thereagainst.

4. An apparatus according to claim 3, in which said means for holding said flap in position is a spring.

5. An apparatus according to claim 1, in which said means for holding said flap in position is a piston/cylinder unit.

6. An apparatus according to claim 1, which includes a steam feed mechanism, and in which said flap is provided with steam introduction openings for introducing steam into said steam channel, with said steam introduction openings communicating with said steam feed mechanism on a side of said flap remote from an interior of said steam channel.

7. An apparatus according to claim 1, in which said flap is adapted to provide a reduction of the cross-sectional area of said steam channel of from 5 to 60%.

8. An apparatus according to claim 1, in which said steam channel has a cross section that is tapered in a funnel-like manner in at least one transverse direction.

9. An apparatus according to claim 8, in which said cross section of said steam channel is tapered up to 10%.

10. An apparatus according to claim 1, which includes an adapter that is disposed upstream of said steam channel and has an end that is connected to said inflow end of said steam channel; in a first transverse direction, said adapter is widened in a funnel-like manner to equal the cross section of said steam channel in this first transverse direction; in a second transverse direction, perpendicular to the first transverse direction, said adapter first has an essentially constant cross section, and subsequently, in the region of said end of said adapter that is connected to said inflow end of said steam channel, is widened in a funnel-like manner to equal the cross section of said steam channel in this second transverse direction.

11. An apparatus according to claim 10, in which said widening of said adapter in said first transverse direction is effected over a distance that is at least twice as long as the distance over which said widening of said adapter in said second transverse direction is effected.

12. An apparatus according to claim 10, in which said flap of said steam channel is pivotable in the plane of said funnel-like widening of said adapter in said first transverse direction.

13. An apparatus according to claim 10, in which the peripheries of said adapter and said steam channel are respectively provided with steam introduction openings that are distributed over said peripheries; and in which a common, heat-insulating housing surrounds both said adapter and said steam channel and has an inlet for receiving saturated steam for supplying said steam introduction openings of said adapter and steam channel.

14. An apparatus according to claim 13, in which a steam feed channel communicates with and leads from said housing to further steam introduction openings provided in said flap.

15. An apparatus according to claim 10, in which the interior of said steam channel is provided with a friction-reducing surface coating.

16. An apparatus according to claim 15, in which the interior of said adapter is also provided with a friction-reducing surface coating.

17. An apparatus according to claim 16, in which said friction-reducing surface coatings comprise PTFE.

* * * * *